US009726468B2

(12) United States Patent
Boyd

(10) Patent No.: US 9,726,468 B2
(45) Date of Patent: Aug. 8, 2017

(54) UNIVERSAL CASE LUBE TRAY

(71) Applicant: Carl B. Boyd, Chicago, IL (US)

(72) Inventor: Carl B. Boyd, Chicago, IL (US)

( * ) Notice: Subject to any disclaimer, the term of this patent is extended or adjusted under 35 U.S.C. 154(b) by 0 days.

(21) Appl. No.: 15/068,538

(22) Filed: Mar. 12, 2016

(65) Prior Publication Data

US 2016/0265891 A1 Sep. 15, 2016

Related U.S. Application Data

(60) Provisional application No. 62/132,555, filed on Mar. 13, 2015.

(51) Int. Cl.
*F42B 33/14* (2006.01)
*F42B 33/10* (2006.01)

(52) U.S. Cl.
CPC ..... *F42B 33/14* (2013.01); *F42B 33/10* (2013.01)

(58) Field of Classification Search
CPC ..... F42B 39/00; F42B 39/26; F42B 39/28; F42B 33/02; F42B 33/14; F42B 33/10; B25H 3/06
USPC ..... D9/758, 760
See application file for complete search history.

(56) References Cited

U.S. PATENT DOCUMENTS 3,813,987 A * 6/1974 Minneman ..... B65D 1/36 206/3
3,990,170 A * 11/1976 Griffis ..... F41A 9/83 206/3
4,027,417 A * 6/1977 Swatek ..... F42B 33/002 206/3
D274,789 S * 7/1984 Brown ..... D9/758
D274,885 S * 7/1984 Joice ..... D9/758
4,811,836 A * 3/1989 Minneman ..... F42B 39/26 206/3
5,052,549 A * 10/1991 Scharch ..... F42B 39/00 206/3
5,316,143 A * 5/1994 Horn ..... B25H 3/06 206/350
5,456,359 A * 10/1995 Horn ..... B25H 3/06 206/350
5,849,377 A * 12/1998 Horikoshi ..... B29C 45/1705 264/328.7
D665,273 S * 8/2012 Castelletti ..... D9/758
(Continued)

OTHER PUBLICATIONS

C Boss USA—Reloading Tray Manufacture, "Case Lube Tray * Reloading Tray * C Boss USA", Oct. 28, 2015, YouTube.*
(Continued)

*Primary Examiner* — Stephen M Johnson
*Assistant Examiner* — Joshua Semick
(74) *Attorney, Agent, or Firm* — Fraline J. Allgaier

(57) ABSTRACT

A case lube tray having an integrally formed polyurethane casing is provided. The case lube tray openings define a plurality of lubricating chambers being used to lubricate shell casings in a horizontal position. The lubricating chambers are mounted on the top frame of the case and are arranged in an array of horizontal rows and vertical columns. Each lubricating chambers features semicircle flooring and a floor center. The semicircle flooring is linear and is supported by front and back lateral walls. The floor center of each lubricating chamber has centrally disposed lateral slots that further allow a user to erect and lubricate shell cases in a vertical position.

12 Claims, 8 Drawing Sheets

(56) References Cited

U.S. PATENT DOCUMENTS 9,038,817 B2 * 5/2015 Connolly ..... B65B 5/08
206/3
9,267,776 B2 * 2/2016 McClaughry ..... F42B 39/26

OTHER PUBLICATIONS

Frankford Arsenal Perfect Fit Reloading Tray, MidwayUSA, Dec. 13, 2013.*
Frankford Arsenal Case Lube 8 oz Pump, MidwayUSA, Dec. 25, 2014.*

* cited by examiner

UNIVERSAL CASE LUBE TRAY

BACKGROUND OF THE INVENTION

The present invention relates to a case lube tray apparatus designed to assist with the organization, positioning and lubrication of firearm cartridges used in the reloading process.

Reloading refers to the private manufacture of cartridges and shell cases (hereinafter cases) using previously fired cases and shotgun hulls using new bullets, shot, primers, and powder. Reloading is also the process of loading firearm cartridges or shotgun shells by assembling the required components rather than purchasing completely assembled, factory-loaded ammunition.

Loading trays are a necessary part of the reloading process. The user can stay organized and continue the reloading process with smaller batches of cases. The cases can remain stationary and prevent dust and other debris from covering the reloading area. The loading trays are also helpful to prevent brass from falling over on a workbench and further causing a messy reloading process. Most loading trays have either a universal one-size-fits-all design or are specialized to load cartridges or cases based on a designated size or a particular family.

Common motivations for reloading cartridges and cases include hobby interest, economy, commercial ammunition shortages and performance. A user can save money and retain a high quantity and quality of ammunition on a budget. Besides economy, additional motivations to reload might include increased accuracy, performance or hobby interests.

Reloading of firearm cartridges involves force and therefore the cartridges or cases would require lubrication during the reloading process. A lubricant creates and retains a barrier between the cases and the reloading elements. It also prevents the cases from being lodged in the barrel of a rifle or pistol and prevents scratches on the exterior surface.

Case lubricants such as waxes are formulated with extreme pressure additives. Extreme pressure additives for lubricants would decrease wear and tear of the parts of the cases after being exposed to very high pressure. Extreme pressure additives would typically contain a variety of chemicals which include but are not limited to chlorine compounds or sulphur-phosporous-boron compounds. These chemicals react with the confined metal surfaces of the cases under high-pressure conditions. Extreme pressure additives used to lubricate early cases included lead soaps and active sulfur or chlorinated compounds. The compounds were later replaced with zinc and phosphorous compounds such as zinc dithiophosphate.

Currently, the lubrication of brass cases is performed in one of four ways. The first is hand lubrication. This method involves lubricating each individual case by applying a jell or paste-like lubricant to the tip of one's finger or on a Q-Tip and manually applying the lubricant to the case. This method is time intensive and not efficient.

The second known method of lubrication is the fish and chicken method. This process incorporates the use of a case lube spray. This involves placing the cases in a plastic bag and applying the lubricant by spraying the lubricant into the bag. One then shakes the bag to mix the lubricant over the brass shell cases. This process is similar to applying batter to fish or chicken. This method is more efficient that the first. One is able to lubricate more cases in a shorter period of time but this method has three inherent flaws. First, not all cases are equally and thoroughly lubricated. Second, the interior portion of the cases become wet and contaminated with the lubricant, thereby dissolving and diluting the gunpowder. Third, one has to wait a minimum of five minutes to allow the interior of the cases to dry prior to initiating the reloading process.

Case lube pads are a third method to lubricate cases. The user of a case lube pad must apply a lubricating jell or paste to the pad and roll the cases over the pad. This process can become quite messy. One can only lubricate a very small number of cases in each session. Finally, the cases can become disorganized and often scattered because the case lube pad has no walls or individual cylinders.

The fourth means and modality used to lubricate cases requires one to position the cases in a case loading tray or ammo loading tray. This tray has the capacity to hold 50 cases in a vertical position. The shell cases are oriented in the tray with the primer side down and the neck or open end of the cases facing up. To lubricate these cases, the re-loader simply sprays the case lube over the cases with the primer side of the cases down. This method's efficiency is equivalent to the Fish and Chicken Method. One is able to lubricate more cases in a shorter period of time but this method has three inherent flaws. First, not all cases are equally and thoroughly lubricated. Second, the interior portion of the cases become wet and contaminated with the lubricant; thereby dissolving and diluting the gunpowder. Third, one has to wait a minimum of five minutes to allow the interior of the cases to dry prior to initiating the reloading process.

To this end, the universal case lube tray of the present invention will make the reloading process easier and more enjoyable. There is quick and easy access to 50 rounds of cases that are easily transported after lubrication.

The cases can be oriented horizontally and vertically. This versatile positioning provides for lubricating chambers being arranged in an array of horizontal rows and vertical columns. The position of a case can be re-adjusted from a vertical lubrication position to a horizontal layout on the semicircle flooring of each of the lubricating chambers.

The case lube tray provides for equal and thorough lubrication of the cases. It is also easier to avoid wetting and contaminating the interior segment of the cases. Compromising the dryness of the interior would cause the gunpowder to dissolve and dilute. If a horizontal position is desired, a user is able to rotate the cases without the cases physically moving down the lube tray. A spray lubricant is applied to the cases, the user then rotates the shells 180 degrees with a slight hand motion and sprays the lubricant a second time for an even application. In a vertical position, the lubricating chamber becomes an engaging means to spread the lubricant as the case is turned about its axis. Excess lubricant would then adhere to the flooring, front lateral wall and back lateral wall of the lubricating chamber. Immediately following this lubrication process, the cases can be resized and further processed by adding the primer, gun powder and bullet necessary to create the reloaded ammunition.

The horizontal and vertical positioning makes it easy to add or remove cases when the case lube tray is full and makes the reloading process more efficient. A single case is easily gripped and removed without jamming the fingers downward into a crowded tray of cases. Finally, the cases can remain organized and the walls of individual lubricating chambers can prevent the cases from rolling off the top frame.

The simple and convenient polyurethane construction allows for a universal molding of the case lube tray into various sizes and colors to closely fit a variety of pistol or rifle cases.

BRIEF SUMMARY OF THE INVENTION

It is therefore an objective of the present invention to address the above concerns and to provide a new apparatus to improve the efficiency and effectiveness of lubricating firearm cartridges and cases used in the reloading process. As such, the general purpose of the present invention is to provide a new and improved case lube tray designed to assist with the organization, positioning and lubrication of firearm cases.

Another objective of the present invention is to provide a new and improved case lube tray having a plurality of lubricating chambers and each lubricating chamber featuring a semicircle flooring and a floor center. The array of lubricating chambers will make the reloading process easier and provide quick and easy access to 50 rounds of cases after lubrication.

Another objective of the present invention is to provide a case lube tray which provides for the orientation of cases in a horizontal position. After a spray lubricant is applied, the user can rotate the cases 180 degrees with a slight hand motion and spray the lubricant a second time for an even application.

Still another objective of the present invention is to provide a novel case lube tray of simple and inexpensive construction, for use with firearm cases and having a universal molding for production into various sizes and colors to closely fit a variety of pistol or rifle cases.

Additional advantages and features of the present invention will become more apparent when considered in light of the following specification and drawings.

DETAILED DESCRIPTION OF THE INVENTION

Figure 1:
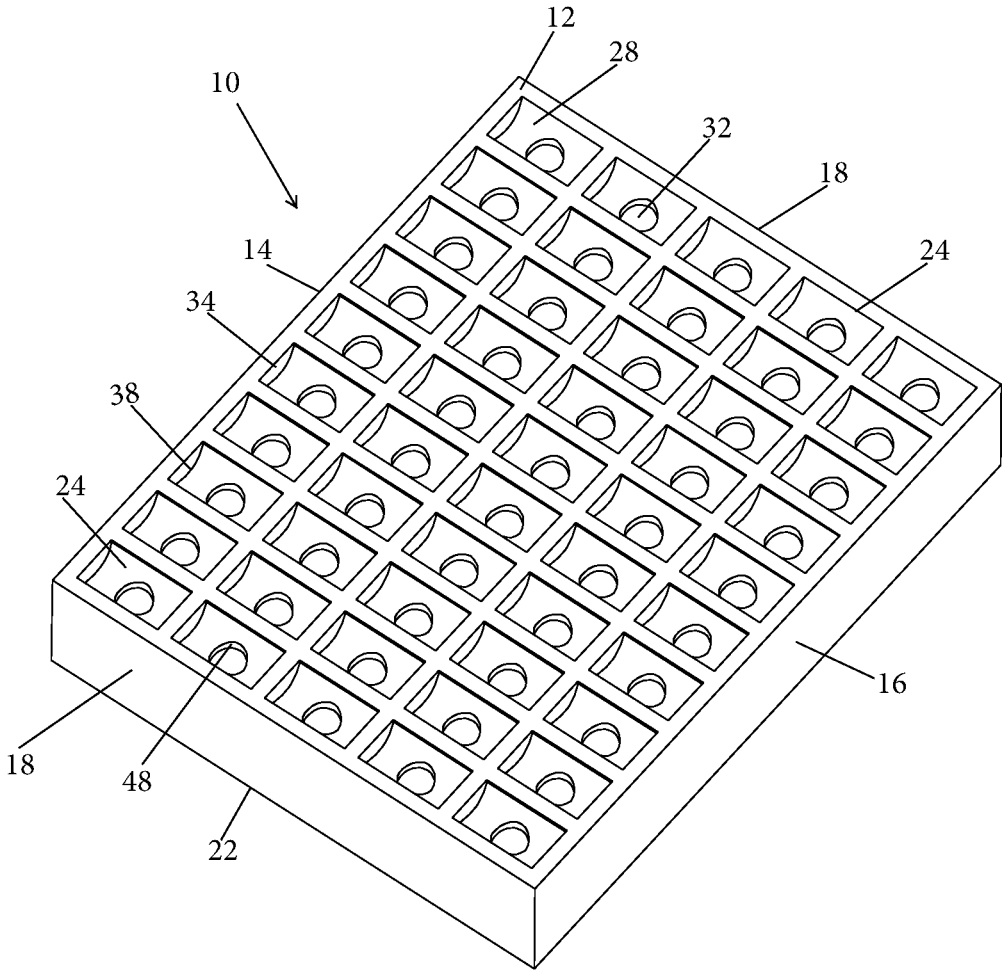
FIG. 1 is a perspective view of the case lube tray.
Figure 2:
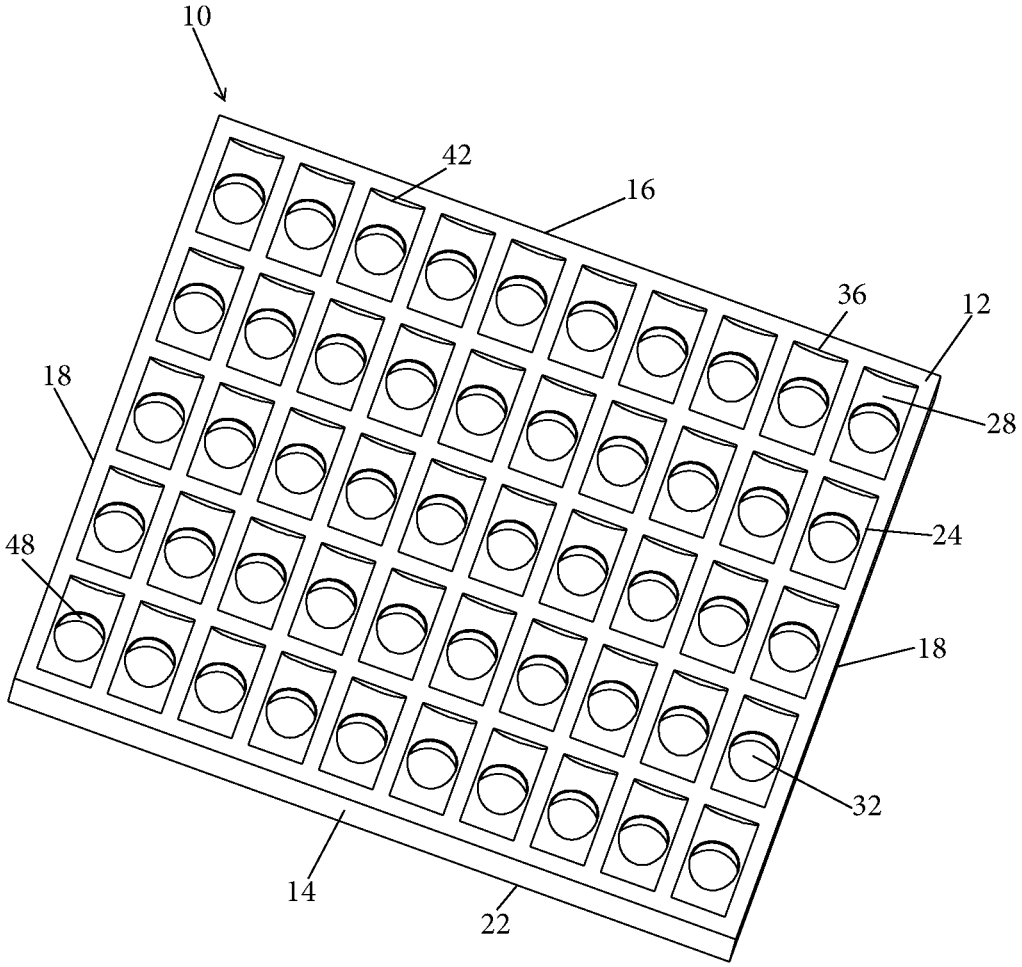
FIG. 2 is a perspective view of the case lube tray.
Figure 3:
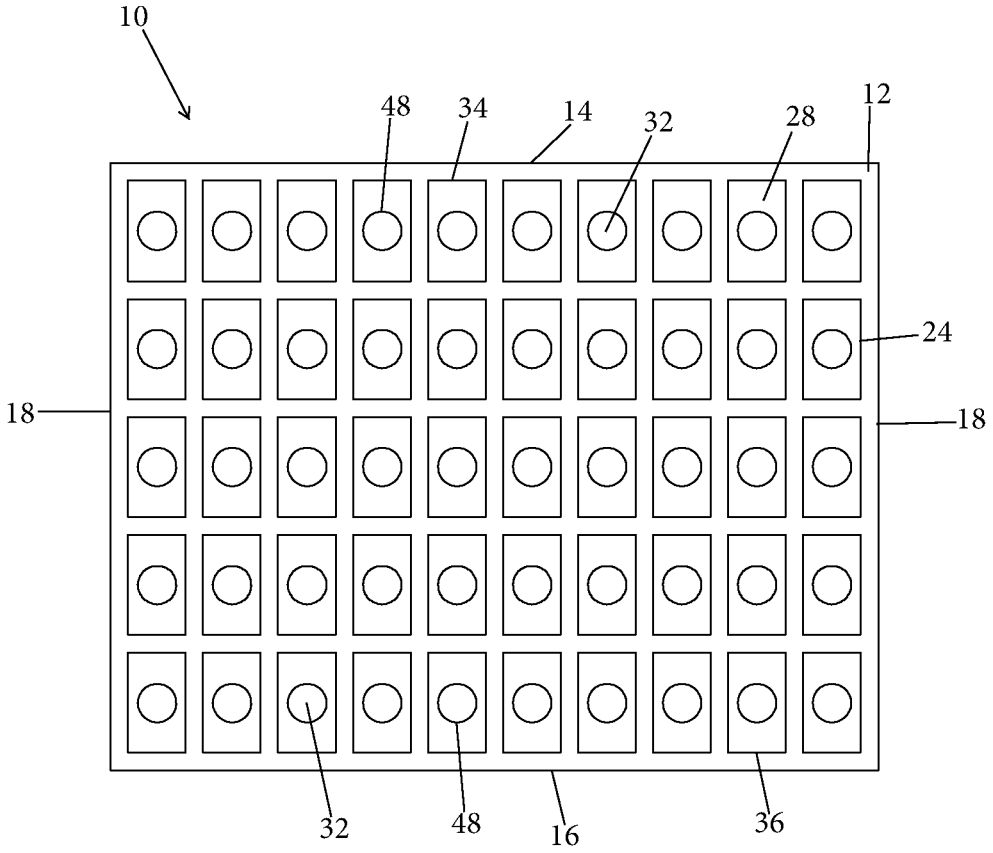
FIG. 3 is a bottom view of the case lube.
Figure 4:
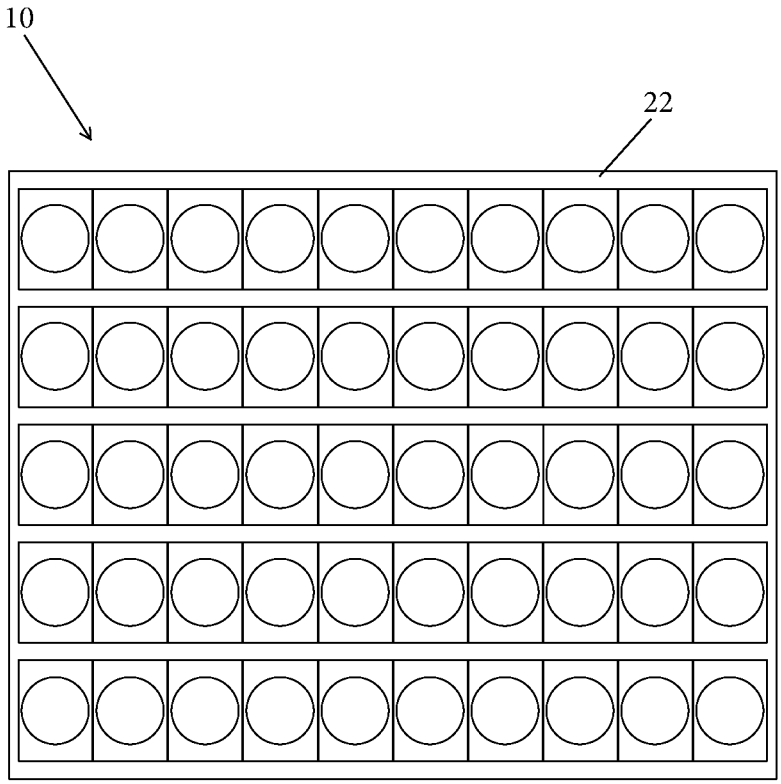
FIG. 4 is a cutaway view of the interior frame of the case lube tray.
Figure 5:
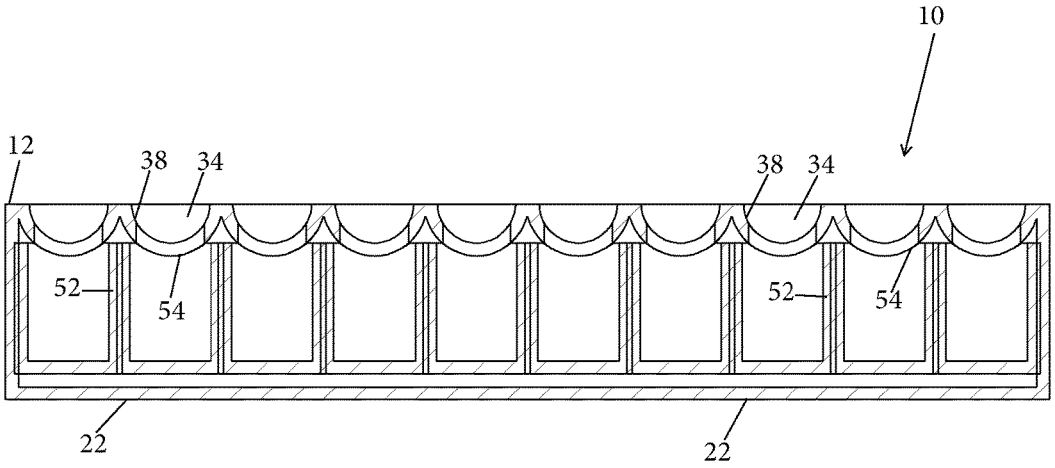
FIG. 5 is a perspective view of the case lube tray.
Figure 6:
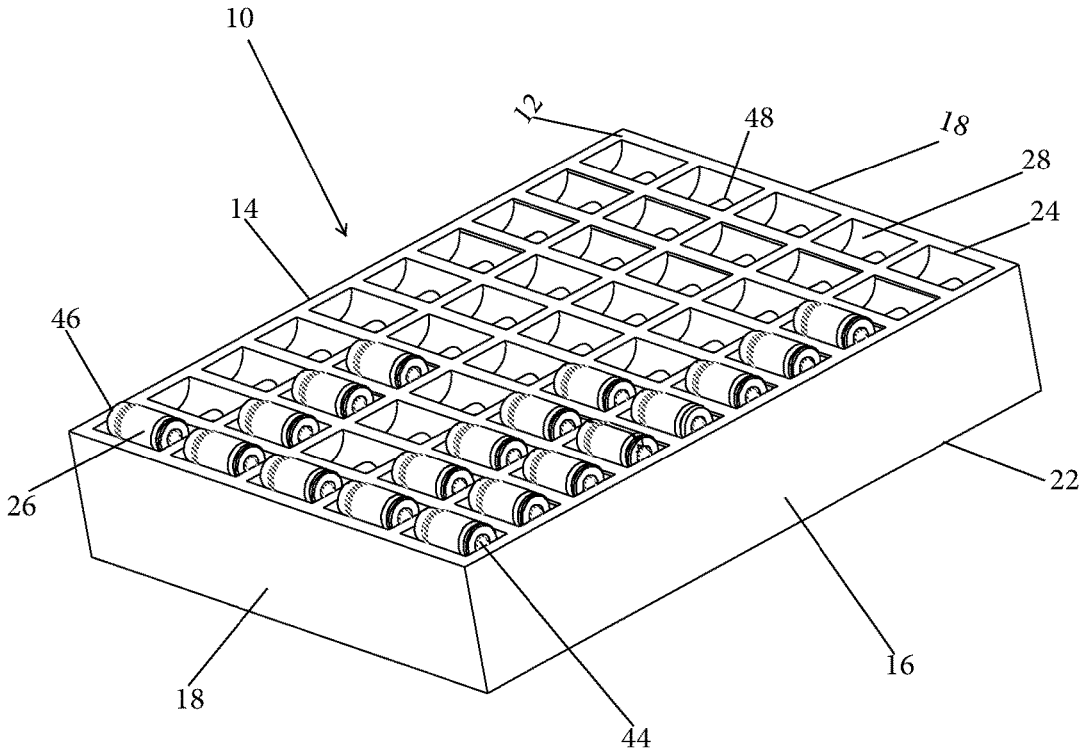
FIG. 6 is a perspective view of the case lube tray.
Figure 7:
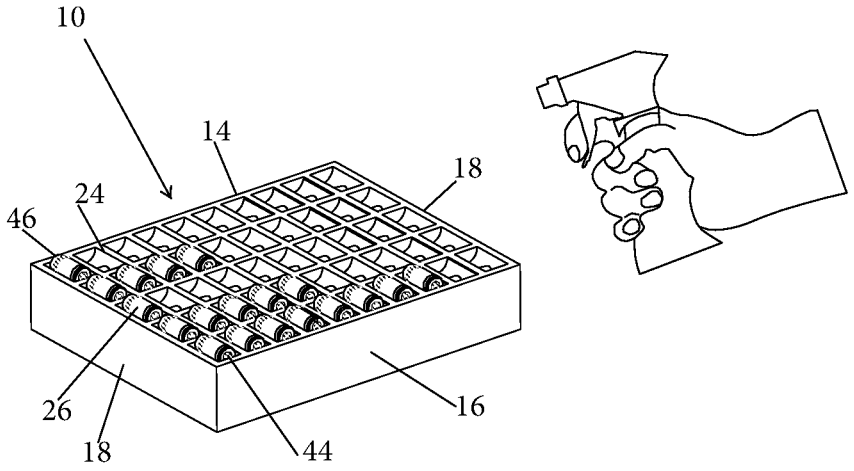
FIG. 7 is a perspective view of the case lube tray.

Referring now to the drawings, FIG. 1 shows the preferred embodiment of the case lube tray of the present invention generally indicated by the numeral 10. The case lube tray 10 has an exterior frame and is provided with a top frame 12, a front wall 14, a back wall 16, and side walls 18 being integral and forming a generally rectangular-shaped base 22. The top frame 12 is provided with openings defining a plurality of lubricating chambers 24.

The lubricating chambers 24 are mounting and lubricating means for shell cases 26 and are arranged in an array of horizontal rows and vertical columns. The shell cases 26 are mounted in a horizontal manner in each lubricating chamber 24 and prepared for lubrication. The user can inspect the lot and search for damaged shell cases 26, residual brass shavings from case-trimming and sort the shell cases 26 by size. The shape of each lubricating chamber 24 is such that appropriate spacing is kept between each shell case 26 and provides a chamber for improved lubrication while maintaining an arrangement of organized shell cases 26.

Variations of spray lubricants include but are not limited to Cabela's Case Spray Lubricant, and Hornady's Case Lube Spray, RCBS Case Slick Spray Lube, Rem Oil Spray. Jell or Paste lubricants include, but are not limited to, MEC Collet Lubricant, Layman Orange Magic Premium Bullet Lube, RCBS Case Lube, Hornady Case Sizing Lube, Hornaday Unique Case Lube and Lee Resizing Lubricant.

A variety of shell cases 26 can be used. These can include the .45-70 rifle cartridge, also known as .45-70 Government and was developed at the United States Army Springfield Armory, the 17 Hornady Mach 2, or .17 HM2, the .17 Hornady Magnum Rimfire (4.5×27 mmR), commonly known as the .17 HMR, .22 Long Rifle rimfire (metric designation: 5.6×15 mmR), the .22 Winchester Magnum rimfire (5.6×27 mmR), the 5 mm/35 SMc, (.22 Hornet or 5.6×35 mmR, the .223 Remington, .223 WSSM (Winchester Super Shot Magnum), the .223 WSSM (Winchester Super Short Magnum, 5.56×42 mm), .243 Winchester (6×52 mm) and the Ackley family of wildcat cartridges including the .17 caliber (4.5 mm) centerfire cartridge.

There is provided within each of the lubricating chambers 24 a semicircle or half-circle style flooring 28 with a linear disposition and a floor center 32. Against the front peripheral edge 38 and back peripheral edge 42 of the semicircle flooring 28 are the front lateral wall 34 and a back lateral wall 36. The front lateral wall 34 and the back lateral wall 36 extend upwardly and are connected to the top frame 12 of the case lube tray 10. The semicircle flooring 28 hold the shell cases 26 in a horizontal configuration and the back end 44 and front end 46 of the shell cases 26 rest along the front lateral wall 34 and the back lateral wall 36 of the lubricating chambers 24. The lower portions of the shell cases 26 are inset relative to the top frame 12 of the case lube tray 10 and are inset to about one ½ of their width.

The floor center 32 has circular slots 48 that are centrally disposed on the semicircle flooring 28. These circular slots 48 allow a user to erect the shell cases 26 vertically and in a manner to lubricate and store the shell cases 26. The circular slots 48 are shaped to fit a variety of shell cases 26 and are at least about ½ inch.

The base 22 has a plurality of support columns 52 to stabilize the case lube tray 10 and for supporting the case lube tray 10 in an upright position. The support columns 52 extend downward from the case lube tray 10 and each support column 52 is connected to the bottom flooring 54 of the lubricating chamber 24. Each lubricating chamber 24 has a bottom flooring 54 for reception of the support columns 52. The support columns 52 extending the periphery of the top frame 12.

Figure 8:
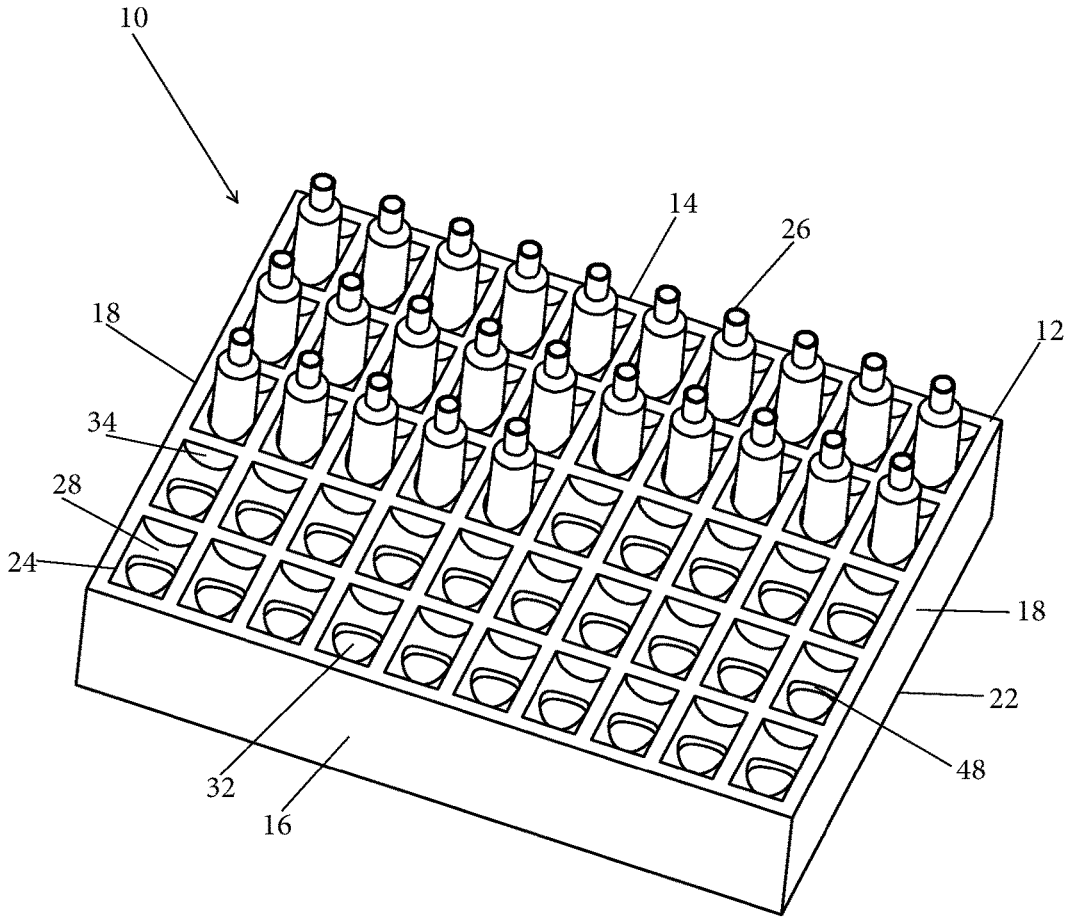
FIG. 8 is a perspective view of the case lube tray.

FIG. 8 shows the case lube tray 10 housing a plurality of shell cases 26 within the circular slots 48 of the lubricating chamber. These circular slots 48 allow a user to erect the plurality of shell cases 26 vertically after being sprayed, lubricated, rolled and held in a linear position along the semicircular flooring 28 and above the floor center 32.

The case lube tray 10 features 50 slots of lubricating chambers 24 having a width of about 0.49 inches and a length of about 0.965 inches. The lubricating chambers 24 have a longitudinal depth of about 0.28 inches, are mounting and lubricating means for 50 shell cases 26 and are adapted to accommodate .22 caliber to .45 caliber shell cases 26 for hand-guns. The lubricating chambers 24 are also mounting means for .223 caliber to .50 caliber Browning machine gun cartridge shell cases 26.

This case lube tray 10 can be utilized primarily in the cartridge or ammunition reloading process. However, it can also be utilized to lubricate or store various sizes of bolts, screws, wires, fuses, welding materials or similar type fasteners.

In the embodiment as disclosed herein, the case lube tray 10 is constructed of a polyurethane material as are the lubricating chambers 24 and their components. In assembly, all parts are integral and therefore a user can mount, inspect, size, organize and lubricate shell cases 26 in each lubricating chamber 24 without the polyurethane structure becoming bent or compressed. This provides for a light-weight constructed container having a strong tensile force against wear and tear from damaged brass, rough metal edges or brass shavings. The configuration of each lubricating chamber 24 withstands pressure without buckling, distorting, or failing at the front peripheral edge 38 and back peripheral edge 42.

The foregoing description and drawings are an explanation and illustration of the invention and the invention is not limited thereto. Those skilled in the art who have access to the disclosure herein will attempt to make modifications and variations without departing from the scope of the invention.

What is claimed is:

1. A case lube tray comprising:

a rectangular body comprising a top frame, a front wall, a back wall, and side walls; said top frame comprising openings defining a plurality of lubricating chambers; said plurality of lubricating chambers configured to hold shell cases; said shell cases having a width, front end, a back end and a lower portion; said plurality of lubricating chambers being arranged in an array of horizontal rows and vertical columns; each of said plurality of lubricating chambers having a semicircular flooring connected to a front lateral wall, a back lateral wall, a front peripheral edge and a back peripheral edge of its associated lubricating chamber; said semicircular flooring configured to hold said shell cases in a horizontal configuration; said semicircular flooring of each of said plurality of lubricating chambers having circular slots that are centrally disposed on said semicircular flooring; said circular slots are recessed and sized to allow a user to erect said shell cases vertically and in a manner to lubricate said shell cases so that the lower portions of said shell cases are inset relative to said semicircular flooring; a base having a plurality of support columns, each of said plurality of support columns connected to a bottom flooring of each of said plurality of lubricating chambers.

2. The case lube tray of claim 1 wherein said plurality of lubricating chambers is 50 lubricating chambers arranged in 5 five rows and 10 columns.

3. The case lube tray of claim 1 wherein said case lube tray is about 1.5 inches in height.

4. The case lube tray of claim 1 wherein said case lube tray is about 6 inches in length.

5. The case lube tray of claim 1 wherein said case lube tray is about 8 inches in width.

6. The case lube tray of claim 1 wherein each of said plurality of lubricating chambers have a width about 0.49 inches.

7. The case lube tray of claim 1 wherein each of said plurality of lubricating chambers have a length of about 0.965 inches.

8. The case lube tray of claim 1 wherein a longitudinal depth of said lubricating chamber is about 0.28 inches.

9. The case lube tray of claim 1 wherein said plurality of lubricating chambers are 50 lubricating chambers.

10. The case lube tray of claim 1 wherein said lubricating chambers are dimensioned to hold .22 caliber to .45 caliber hand gun shell cases in the horizontal configuration.

11. The case lube tray of claim 1 wherein said lubricating chambers are dimensioned to hold .223 caliber to .50 caliber rifle shell cases.

12. The case lube tray of claim 1 wherein said case lube tray is made of a polyurethane material.

* * * * *